US006755039B2

(12) United States Patent
Tsuboi

(10) Patent No.: US 6,755,039 B2
(45) Date of Patent: Jun. 29, 2004

(54) SCREW REFRIGERATING APPARATUS

(75) Inventor: Noboru Tsuboi, Kako-gun (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 10/653,975

(22) Filed: Sep. 4, 2003

(65) Prior Publication Data

US 2004/0050081 A1 Mar. 18, 2004

(30) Foreign Application Priority Data

Sep. 17, 2002 (JP) ..... 2002-270242
Nov. 5, 2002 (JP) ..... 2002-321339
Apr. 8, 2003 (JP) ..... 2003-104232

(51) Int. Cl.[7] ..... F25B 41/00

(52) U.S. Cl. ..... 62/197; 62/505; 62/508; 62/468; 62/113

(58) Field of Search ..... 62/197, 505, 508, 62/468, 469, 113

(56) References Cited

U.S. PATENT DOCUMENTS 3,710,590 A * 1/1973 Kocher ..... 62/468
4,234,296 A * 11/1980 Matsubara et al. ..... 418/201.2

FOREIGN PATENT DOCUMENTS

JP 1-273894 11/1989
JP 409268988 A * 10/1997
JP 410274180 A * 10/1998

* cited by examiner

*Primary Examiner*—Melvin Jones
(74) *Attorney, Agent, or Firm*—Oblon, Spivak, McClelland, Maier & Neustadt, P.C.

(57) ABSTRACT

A screw refrigerating apparatus comprising a refrigerant circulating passage including a screw compressor, a condenser, an expansion valve, and an evaporator is constituted such that a bypass flow passage branching at a part of the refrigerant circulating passage between the condenser and the expansion valve, routing through throttle means, and communicating with a rotor room within the screw compressor is provided. The screw refrigerating apparatus is capable of simplifying the structure, decreasing the size, decreasing labor of the maintenance, and the like.

7 Claims, 5 Drawing Sheets

SCREW REFRIGERATING APPARATUS

BACKGROUND OF THE INVENTION

1. Field of the Invention

The present invention relates to a screw refrigerating apparatus using a screw compressor.

Conventionally, a screw refrigerating apparatus using a screw compressor is publicly known (see Patent Document 1, for example).

2. Description of the Related Art

The screw compressor is roughly categorized into an oil-cooled type screw compressor and an oil-free type screw compressor. In an oil-cooled type screw compressor, oil is filled in a rotor room in order to seal between rotors, and between the rotors and an inner wall surface of the rotor room, to cool parts whose temperature increases due to compressing, to lubricate, and the like. In an oil-free type screw compressor, oil is not filled into a rotor room, bearings are completely sealed from the rotor room with a seal, and a synchronous gear is used for transmitting a rotation drive force between male and female rotors. In terms of the structure of a main unit of the compressor, the oil-free type screw compressor is considerably complex compared with the oil-cooled type screw compressor, and the oil-free type screw compressor is more expensive than the oil-cooled type screw compressor by the increased complexity while it is assumed that the same quantity of air is discharged. Further, compared with the oil-cooled type screw compressor, the oil-free type screw compressor has larger gaps between the rotors, and between the rotors and the inner wall surface, and a larger quantity of gas leaks through these gaps. Therefore, the oil-cooled type screw compressor is generally used, and the oil-free type screw compressor is not used except for a special case where compressed gas is not allowed to contain lubricant, and only clean compressed gas is required.

In a screw refrigerating apparatus described in Japanese Unexamined Patent Application Publication H1-273894, an oil-cooled type screw compressor is used, the refrigerant gas sucked by the screw compressor is discharged from the screw compressor along with oil after compressed while being filled with the oil in the rotor room. Thus, an oil separating and collecting unit (oil separator) for separating and collecting the oil from the compressed refrigerant gas discharged from the screw compressor, an oil cooling unit (oil cooler) for cooling the collected oil, an oil filter (oil strainer) for cleaning the oil, and an oil flow passage for leading the oil into the rotor room again after passing through these units, and passage for repeating circulation of the oil are provided.

The conventional screw refrigerating apparatus described above has following problems: The oil separating and collecting unit, the oil cooling unit, the oil filter, and an oil piping for the oil flow passage are required. These units occupy a large portion with respect to the volume of the overall apparatus. The apparatus becomes bulky. The installation space increases. The apparatus has more complicated structure. The cost increases accordingly, simultaneously, maintenance exerts a heavy burden, and the like.

SUMMARY OF THE INVENTION

The present invention was devised for eliminating these conventional problems as its objective, and is intended to provide a screw refrigerating apparatus for simplifying the structure, reducing the size, reducing the burden of the maintenance, and the like.

To solve the problems described above, in a first invention, in a screw refrigerating apparatus comprising a refrigerant circulating passage which includes a screw compressor, a rotor room within said screw compressor, a condenser, an expansion valve, and an evaporator, the screw refrigerating apparatus comprises throttle means and a bypass flow passage branching at a part of the refrigerant circulating passage between the condenser and the expansion valve, routing through the throttle means, and communicating with the rotor room.

Since the bypass flow passage is provided in this way, and the cooled refrigerant in the mixed gas/fluid state is led to the rotor room of the screw compressor, and provides the effects of lubricating, sealing, and further cooling in the rotor room, even when a screw compressor has the same structure as a screw compressor which is conventionally designed as oil-cooled type is employed for the screw refrigerating apparatus according to the first invention, it is no longer necessary to fill lubricant into the rotor room for the effect of the lubricating, sealing, and cooling, and it is possible to eliminate apparatuses, piping and the like for the lubricant which leads only the lubricant into the rotor room and circulates the lubricant. Namely, while if lubricant is used for above mentioned lubricating, sealing and cooling, an oil separating and collecting unit, an oil cooling unit, an oil filter, an oil flow passage for circulating lubricant including these apparatuses for lubricant, and the like are necessary, the constitution described above according to the first invention entirely eliminates these apparatuses for lubricant and the piping, and the like, and provides effects of enabling simplifying the structure, reducing the size, reducing the burden of the maintenance, and the like.

A second invention has such a constitution that refrigerant circulating in the refrigerant circulating flow passage contains a quantity of lubricant as much as restraining a decrease of heat transfer efficiency due to the lubricant in the condenser and the evaporator to a practically negligible degree, in addition to the constitution according to the first invention.

Consequently, the second invention provides effects of enabling lubricating the bearings, preventing the parts from corroding where the lubricant circulates, and increasing the durability of them in addition to the effects of the first invention.

A third invention has such a constitution that the bypass flow passage branches from a top part of the refrigerant circulating flow passage when the specific gravity of the lubricant is lower than the specific gravity of the refrigerant, and the bypass flow passage branches from a bottom part of the refrigerant circulating flow passage when the specific gravity of the lubricant is higher than the specific gravity of the refrigerant, in addition to the constitution according to the second invention.

Consequently, an effect of enabling further increasing the effects of the second invention is provided.

A fourth invention has such a constitution that comprising a discharged refrigerant temperature detector provided for detecting the refrigerant temperature between the screw compressor and the condenser, and for outputting a temperature signal indicating the detected temperature, and a variable throttle valve employed as the throttle means interposed on the bypass flow passage, wherein the variable throttle valve increases its opening as the detected temperature becomes high, in addition to the constitution according to any one of the inventions 1 to 3.

Consequently, even when a load on the refrigeration changes, the quantity of the refrigerant led from the bypass flow passage II to the rotor room is always maintained properly such that the discharge temperature of the screw compressor 11 is maintained to a desired value.

A fifth invention has such a constitution that comprises a driving unit of the screw compressor comprising an inverter and a variable speed motor controlled by the inverter, a temperature detector for detecting the refrigerant temperature inside the evaporator, and for outputting a temperature signal indicating the detected temperature, and a controller for receiving the temperature signal, and for outputting a control signal to the inverter to change the rotation speed of the variable speed motor so that the detected temperature is equal to a set temperature, in addition to the constitution according to any one of the inventions 1 to 4.

A sixth invention has such a constitution that comprises a driving unit of the screw compressor comprising an inverter and a variable speed motor controlled by the inverter, a pressure detector for detecting the refrigerant pressure between the evaporator and the screw compressor, and for outputting a pressure signal indicating the detected pressure, and a controller for receiving the pressure signal, and for outputting a control signal to the inverter to change the rotation speed of the variable speed motor so that the detected pressure is equal to a set pressure, in addition to the constitution according to any one of the inventions 1 to 4.

Consequently, with the fifth and sixth inventions, even when the oil is not used, the capacity of the screw compressor can be adjusted by controlling the rotation speed of the variable speed motor with the inverter, thereby providing an effect of enabling maintaining the refrigerating capability properly, in addition to the effects of any one of the first to fourth inventions.

In a seventh invention, in a screw refrigerating apparatus comprising a refrigerant circulating passage which includes a screw compressor, a rotor room within the screw compressor, a condenser, an expansion valve; and an evaporator, the screw refrigerating apparatus comprises a fluid lubricated bearing inside the screw compressor, first throttle means, a bypass flow passage branching at a part of the refrigerant circulating passage between the condenser and the expansion valve, routing through the first throttle means, and communicating with the rotor room, second throttle means and a bearing-fluid-filling flow passage branching at a part of the refrigerant circulating passage between the condenser and the expansion valve, routing through the second throttle means, and communicating with the fluid lubricated bearing.

Therefore, it is not either necessary to provide a flow passage for supplying the bearings with oil, thereby further simplifying the constitution of the apparatus, and eliminating the labor of maintenance operation, in addition to the effects of the first invention.

DESCRIPTION OF THE PREFERRED EMBODIMENTS

The section below describes embodiments of the present invention following drawings.

Figure 1:
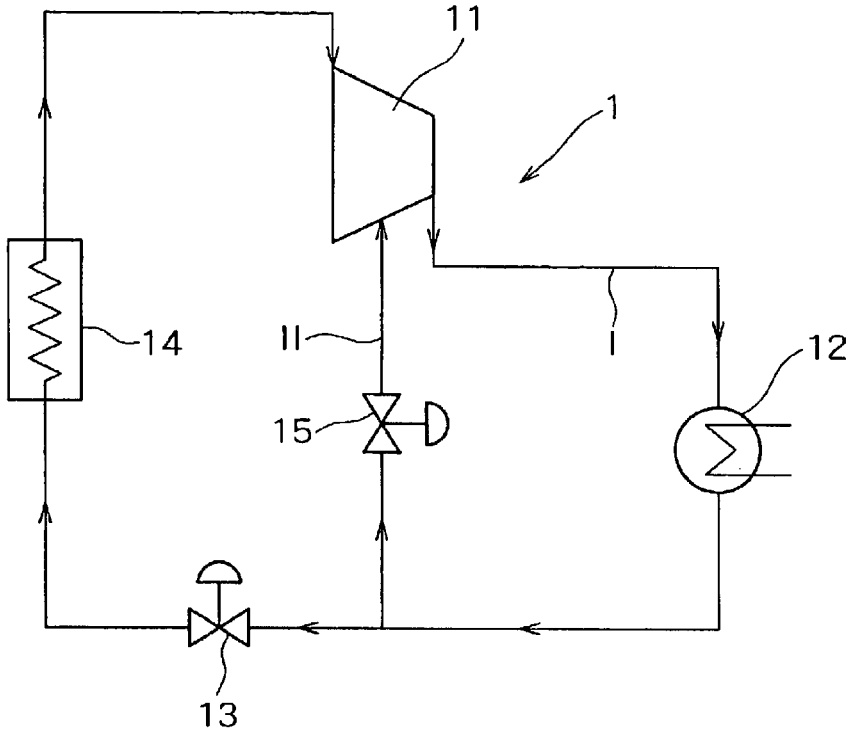
FIG. 1 is a drawing showing an overall constitution of a screw refrigerating apparatus according to a first embodiment of the present invention.

FIG. 1 shows a screw refrigerating apparatus 1 according to a first embodiment of the present invention. In this screw refrigerating apparatus 1, a refrigerant circulating flow passage I includes a screw compressor 11 having an unillustrated rotor room rotationally storing a pair of male and female screw rotors meshing with each other, a condenser 12, an expansion valve 13, and an evaporator 14. A bypass flow passage II branches at a part of the refrigerant circulating passage I between the condenser 12 and the expansion valve 13, routes through throttle means 15, and communicates with the rotor room. Anything having a throttle effect may be used for the throttle means 15. The throttle means 15 may be an orifice, a fixed throttle valve, or a variable throttle valve.

The refrigerant in the gas state sucked by the screw compressor 11 is compressed, is discharged from the screw compressor 11 to the condenser 12, and releases the heat to the outside through heat exchange in the condenser 12. The refrigerant in the gas state is condensed by cooling, and proceeds to the expansion valve 13 in the fluid state. A part of the refrigerant in the fluid state branches into the bypass flow passage II, and the remaining refrigerant is led to the expansion valve 13. The remaining refrigerant is evaporated through adiabatic expansion in a process of passing through the expansion valve 13 while remaining a part in the fluid state, and reaches the evaporator 14 in a mixed gas/fluid state. Further, this refrigerant draws heat from the outside by heat exchange in the process of passing through the evaporator 14, and consequently the refrigerant in the fluid state also evaporates. The refrigerant in the gas state is delivered out from the evaporator 14 to and sucked by the screw compressor 11.

On the other hand, the refrigerant in the fluid state having branched to the bypass flow passage II, which has released heat through the condenser 12, thus, has been cooled, partially evaporates in the process of passing through the throttle means 15, becomes the mixed gas/fluid state such as refrigerant in the fluid state of 60 WT % and refrigerant in the gas state of 40 WT %, and is led to the rotor room inside the screw compressor 11. Then, the refrigerant in the fluid state seals and lubricates between the rotors, and between the rotors and the inner wall surface of the rotor room. Simultaneously, the refrigerant in the fluid state and the gas state, especially by the effect of drawing heat of evaporation from the surroundings when the refrigerant in the fluid state evaporates, cools a part with an increased temperature caused by compressing action in the rotor room. Finally, the refrigerant from the bypass flow passage II becomes a complete gas state in the rotor room, is compressed along with the refrigerant sucked from the evaporator 14 into the screw compressor 11, and is delivered out to the condenser 12. The once-mixed refrigerant in the gas state branches to the expansion valve 13 side and to the throttle valve 15 side after having become the fluid state through the condenser 12 again, and repeats circulation in the same way afterwards.

In this way, the refrigerant in the mixed gas/fluid state from the bypass flow passage II is used for sealing, lubricating, and cooling in the rotor room as described above rather than using conventional lubricant in the screw refrigerating apparatus 1. Therefore, in the screw refrigerating apparatus 1, an oil separating and collecting unit, an oil cooling unit, an oil filter, and an oil flow passage for circulating lubricant including these apparatuses for lubricant are completely eliminated. They used to be considerably dominant in terms of the increase of the complexity of the structure, further the increase of the volume and the installation area of the entire apparatus, and the increase of the cost, when lubricant is conventionally used. An extremely simple bypass flow passage II replaces them, and consequently, maintenance relating to the lubricant, which used to be a burden when the lubricant was used is also eliminated.

As for bearings in the screw compressor 11, even when fluid is used for their lubrication, since the quantity of the required fluid is extremely small compared with the quantity of the refrigerant led to the rotor, a part of the refrigerant from the bypass flow passage II may be led for lubricating the bearings. Alternatively, bearings which do not require lubrication may be used.

The pressure of the refrigerant at the branch from the refrigerant circulating flow passage I to the bypass flow passage II is approximately equal to the discharge pressure of the screw compressor 11. On the other hand, the pressure at a gas compressing unit in the rotor room and the pressure at a suction part of the screw compressor 11 are naturally lower than the discharge pressure of the screw compressor 11. Therefore, the refrigerant in the bypass flow passage II can be merged with the refrigerant after routing through the evaporator 14 using the pressure difference between the refrigerants. In that case, the merging position may be either the suction part of the screw compressor 11 or the gas compressing unit in the rotor room.

Further, the screw compressor 11 is not limited to one provided with a compressor main unit on a single stage, and includes one provided with compressor main units on multiple stages arranged serially where the refrigerant is led to the individual rotor room of the compressor main units on multiple stages from the bypass flow passage II.

While only the refrigerant is used in the above description provided for the screw refrigerating apparatus 1, refrigerant mixed with lubricant within a range restraining a decrease of heat transfer efficiency due to the lubricant in the condenser 12 and the evaporator 14, which are a type of heat exchangers, to a practically negligible degree. Namely, a certain quantity of about 1 to 3 WT % with respect to the refrigerant may be used for the screw refrigerating apparatus 1. The present invention also includes the screw refrigerating apparatus 1 using lubricant with this certain quantity. In this way, it can be said that mixing a certain quantity of lubricant as much as the degree described above is preferable in terms of lubricating the bearings, in terms of preventing lubricant circulating parts including the bearings from corroding, and further in terms of increasing the durability of them rather than it does not cause a practical problem.

Figure 2:
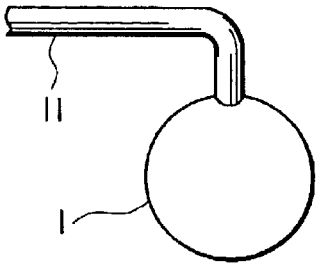
FIG. 2 is a partial sectional view showing a branching part of a bypass flow passage from a refrigerant circulating flow passage in the screw refrigerating apparatus shown in FIG. 1.
Figure 3:
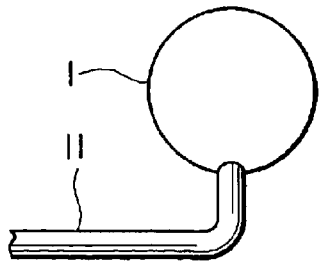
FIG. 3 is a partial sectional view showing another example of the branching part of the bypass flow passage from the refrigerant circulating flow passage in the screw refrigerating apparatus shown in FIG. 1.

Also, in the screw refrigerating apparatus 1 where a quantity of lubricant to the degree described above is mixed with the refrigerant, it is preferable to provide the branch from the refrigerant circulating flow passage I to the bypass flow passage II at a top part of the refrigerant circulating flow passage I as shown in FIG. 2 when the specific gravity of the lubricant is lower than the specific gravity of the refrigerant in the fluid state, and to provide the branch at a bottom part as shown in FIG. 3 when the specific gravity of the lubricant is higher than the specific gravity of the refrigerant in the fluid state.

Then, with this constitution, the lubricant along with the refrigerant can be led from the bypass flow passage II to the rotor room in the state where the ratio of the lubricant to the refrigerant is increased. Consequently, the effect of increasing lubrication of the bearings, and prevention of corrosion of the piping system including the bearings, and their durability described above can be increased.

Figure 4:
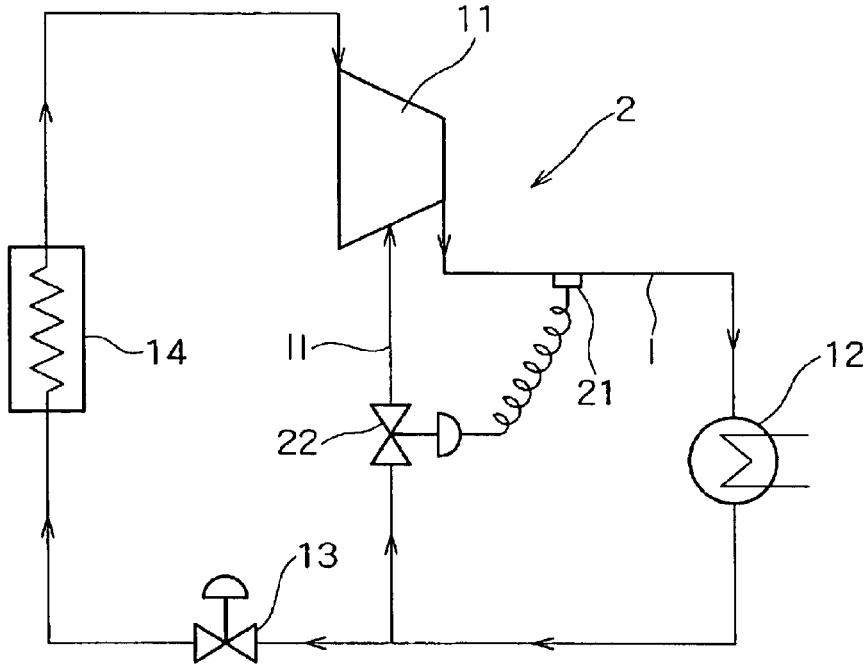
FIG. 4 is a drawing showing an overall constitution of a screw refrigerating apparatus according to a second embodiment of the present invention.

FIG. 4 shows a screw refrigerating apparatus 2 according to a second embodiment of the present invention, and is practically the same as the screw refrigerating apparatus 1 shown in FIG. 1 except that a discharged refrigerant temperature detector 21 and a variable throttle valve 22 in place of the throttle means 15 are newly provided. The same numerals are assigned to the mutually common parts, and description for them is not provided.

In this screw refrigerating apparatus 2, the discharged refrigerant temperature detector 21 provided between the screw compressor 11 and the condenser 12 transmits a temperature signal indicating the detected temperature of the refrigerant to the variable throttle valve 22. The opening of the variable throttle valve 22 changes based on this temperature signal. The opening of the variable throttle valve 22 increases when the detected temperature is high, and decreases when the detected temperature is low.

For example, a sensitive tube encapsulating a coolant having temperature dependent on the temperature of discharged refrigerant from the screw compressor 11 is adopted as the discharged refrigerant temperature detector 21, and a thermovalve having a valve disc opening dependent on the temperature rise of the coolant in the temperature-sensitive tube is adopted as the variable throttle valve 22. An electronic thermometer may be adopted as the discharged refrigerant temperature detector 21, and an electronic valve may be adopted as the variable throttle valve 22.

The opening of the variable throttle valve 22 may become large in proportion to the signal of the temperature detector 21, or become large stepwise according to the signal of the temperature detector 21.

Then, with this constitution, even when a load on the refrigeration changes, the quantity of the refrigerant led from the bypass flow passage II to the rotor room is always maintained properly such that the discharge temperature of the screw compressor 11 is maintained to a desired value.

Note that, in FIG. 1 and FIG. 4, since a motor driving the screw compressor 11 and a power supply for supplying the motor with electric power are not especially necessary for describing the present invention, they are not illustrated in these drawings.

Figure 5:
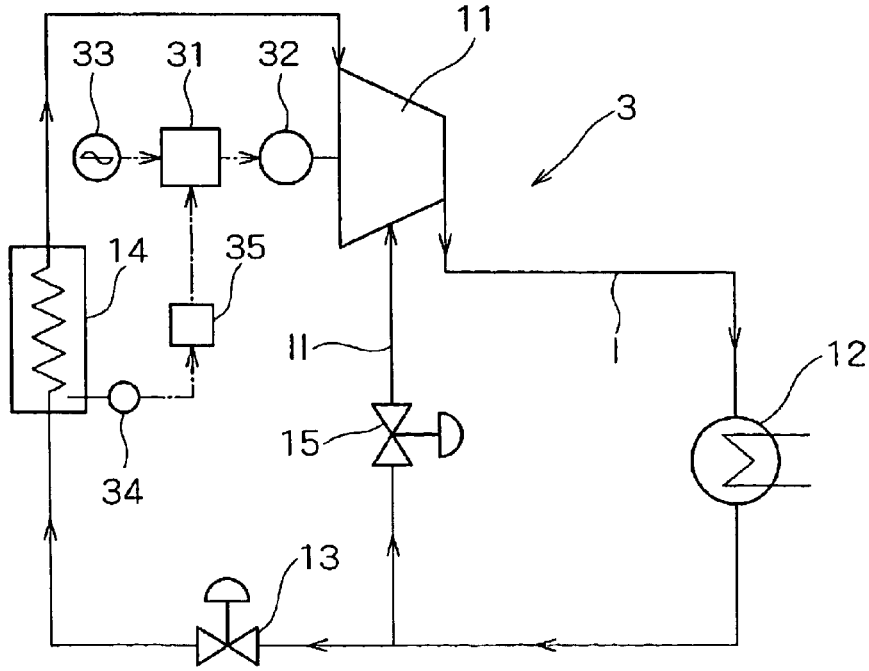
FIG. 5 is a drawing showing an overall constitution of a screw refrigerating apparatus according to a third embodiment of the present invention.

FIG. 5 shows a screw refrigerating apparatus 3 according to a third embodiment of the present invention. Parts mutually common with the screw refrigerating apparatus 1 shown in FIG. 1 are assigned with the same number, and description is not provided for them.

In this screw refrigerating apparatus 3, a variable speed motor 32 whose rotation speed is controlled by an inverter 31 is employed for the screw compressor 11. The inverter 31 is interposed between the power supply 33 and the variable speed motor 32. Additionally, a temperature detector 34 for detecting the refrigerant temperature inside the evaporator 14, and outputting a temperature signal indicating the detected temperature, and a controller 35 for receiving this temperature signal, and outputting a control signal to the inverter 31 are provided. The controller 35 changes the rotation speed of the variable speed motor 32 such that the detected temperature is equal to the set temperature.

Then, the control signal for increasing the rotation speed of the variable speed motor 32 if the detected temperature is higher than the set temperature, or the control signal for decreasing the rotation speed of the variable speed motor 32 in the opposite case, is outputted from the controller 35 to the inverter 31, thereby changing the rotation speed of the variable speed motor 32. Namely, the capacity of the screw compressor 11 is adjusted.

Figure 6:
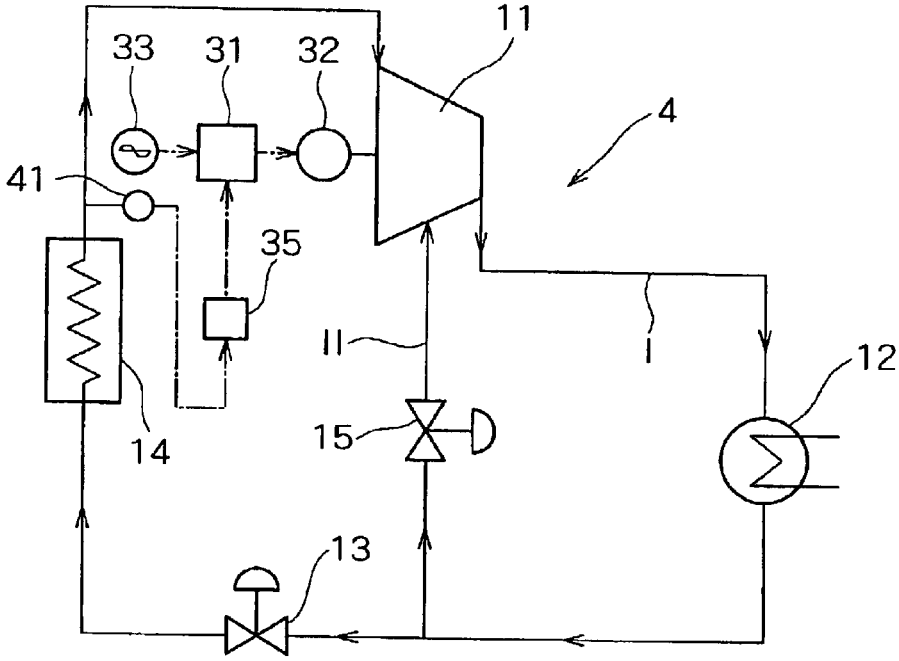
FIG. 6 is a drawing showing an overall constitution of a screw refrigerating apparatus according to a fourth embodiment of the present invention.

FIG. 6 shows a screw refrigerating apparatus 4 according to a fourth embodiment of the present invention, and is practically the same in terms of illustration as the screw refrigerating apparatus 3 shown in FIG. 5 except that a pressure detector 41 in place of the temperature detector 34 is provided. The same numerals are assigned to the mutually common parts, and description for them is not provided.

In this screw refrigerating apparatus 4, the pressure detector 41 for detecting the refrigerant pressure between the evaporator 14 and the screw compressor 11, and outputting a pressure signal indicating the detected pressure, and a controller 35 for receiving this pressure signal, and outputting a control signal to the inverter 31 are provided. The controller 35 changes the rotation speed of the variable speed motor 32 such that the detected pressure is equal to the set pressure.

Then, the control signal for increasing the rotation speed of the variable speed motor 32 if the detected pressure is higher than the set pressure, or the control signal for decreasing the rotation speed of the variable speed motor 32 in the opposite case, is outputted from the controller 35 to the inverter 31, thereby changing the rotation speed of the variable speed motor 32. Namely, the capacity of the screw compressor 11 is adjusted.

Figure 7:
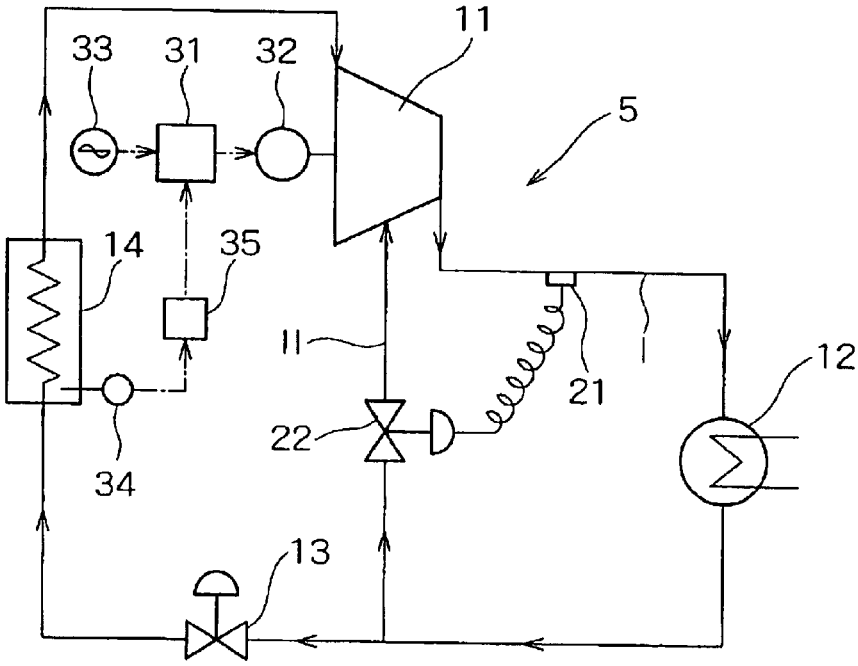
FIG. 7 is a drawing showing an overall constitution of a screw refrigerating apparatus according to a fifth embodiment of the present invention.

FIG. 7 shows a screw refrigerating apparatus 5 according to a fifth embodiment of the present invention, and is practically the same as the screw refrigerating apparatus 5 shown in FIG. 5 except that the abovementioned discharged refrigerant temperature detector 21 and variable throttle valve 22 in place of the throttle means 15 are newly provided. The same numerals are assigned to the mutually common parts, and description for them is not provided.

Figure 8:
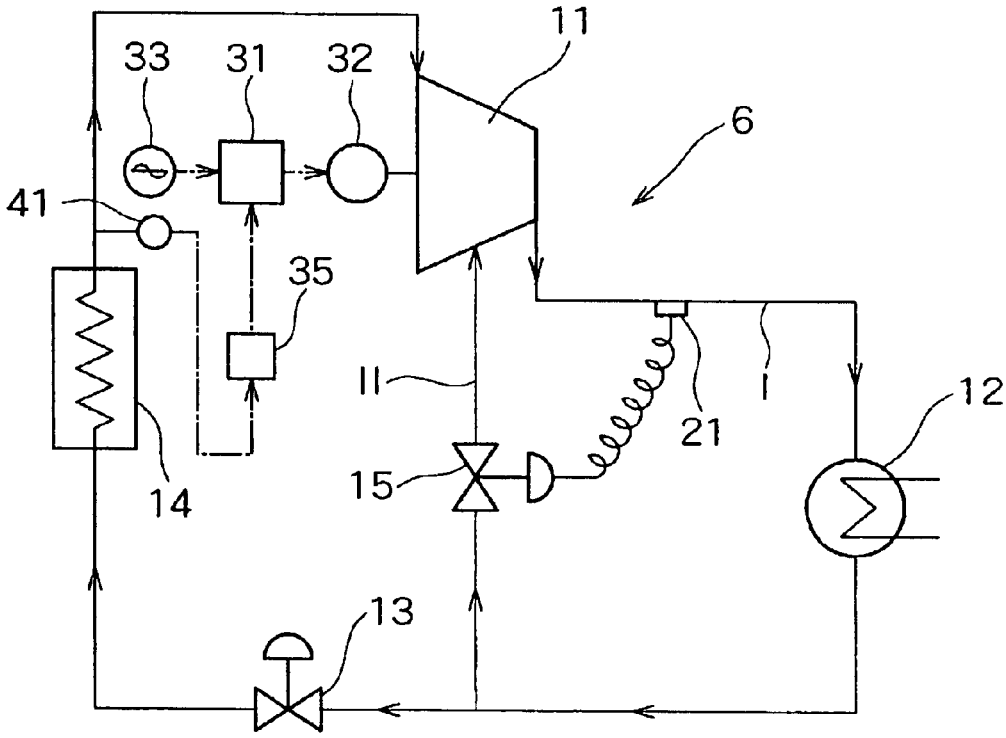
FIG. 8 is a drawing showing an overall constitution of a screw refrigerating apparatus according to a sixth embodiment of the present invention.

FIG. 8 shows a screw refrigerating apparatus 6 according to a sixth embodiment of the present invention, and is practically the same as the screw refrigerating apparatus 4 shown in FIG. 6 except that the discharged refrigerant temperature detector 21 and the variable throttle valve 22 in place of the throttle means 15 are newly provided as described above. The same numerals are assigned to the mutually common parts, and description for them is not provided.

In these screw refrigerating apparatuses 5 and 6, the discharged refrigerant temperature detector 21 provided between the screw compressor 11 and the condenser 12 transmits a temperature signal indicating the detected temperature of the refrigerant to the variable throttle valve 22, and the opening of the variable throttle valve 22 changes based on this temperature signal. Namely, the opening of the variable throttle valve 22 increases when the detected temperature is high, and decreases when the detected temperature is low.

Then, with this constitutions, even when the load on the refrigeration changes, the inverter 31 changes the rotation speed of the variable speed motor 32, and thus, the capacity of the screw compressor 11 is adjusted, the quantity of the refrigerant led from the bypass flow passage II to the rotor room is always maintained appropriately in response to the capacity after the adjustment.

Figure 9:
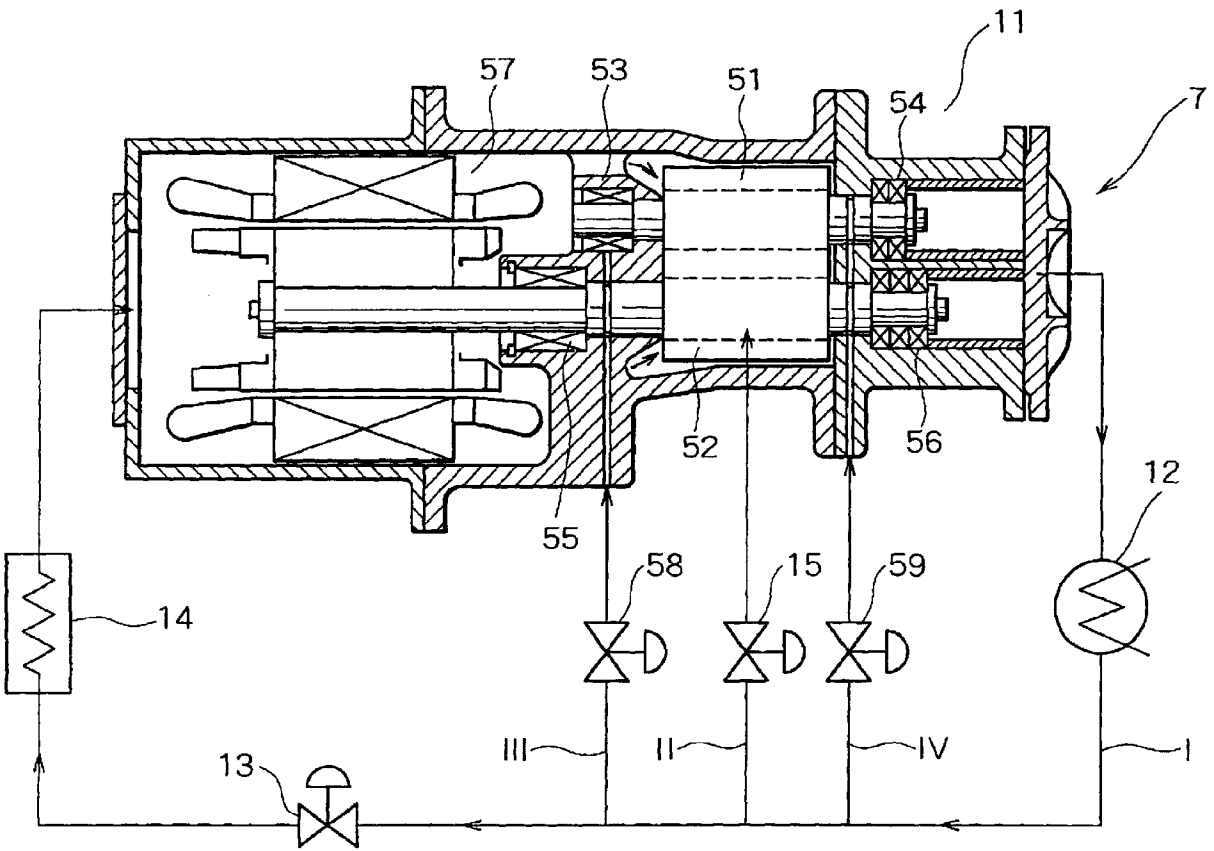
FIG. 9 is a drawing showing an overall constitution of a screw refrigerating apparatus according to a seventh embodiment of the present invention.

FIG. 9 shows a screw refrigerating apparatus 7 according to a seventh embodiment of the present invention, and the same numerals are assigned to the mutually common parts in the individual embodiments described above.

The screw compressor 11 of the screw refrigerating apparatus 7 rotationally stores a pair of male and female screw rotors 51 and 52 meshing with each other as described above. Rotor shafts extending on both sides of the screw rotor 51 and on both sides of the screw rotor 52 are supported respectively by fluid lubricated bearings 53, 54, 55, and 56. These fluid lubricated bearings 53, 54, 55, and 56 do not necessarily require oil as lubricant, and may sufficiently use fluid refrigerant. Rolling elements positioned between an inner ring and an outer ring may be formed with a ceramic material, for example, the inner ring and the outer ring are preferably made of SUJ (bearing steel). All of the outer ring, the inter ring, and the rolling elements are more preferably made of a ceramic material. In addition, proper types of bearings such as angular ball bearings and cylindrical roller bearings are selected for fluid lubricated bearings 53, 54, 55, and 56 depending on the direction, namely, the radial direction or the axial direction, of the force to support.

The rotor shaft of the one screw rotor 52 is provided so as to rotate integrally with an output shaft of the motor 57.

In addition, bearing-fluid-filling flow passages III and IV branching from a part of the refrigerant circulating passage I between the condenser 12 and the expansion valve 13 in addition to the bypass flow passage II as described above are connected with the screw compressor 11, throttle means 58 is interposed in the bearing-fluid-filling flow passage III, and throttle means 59 is interposed in the bearing-fluid-filing flow passage IV This bearing-fluid-filling flow passage III supplies the fluid lubricated bearings 53 and 55 supporting the rotor shafts on the suction side of the screw rotors 51 and 52 with the branched refrigerant. The bearing-fluid-filling flow passage IV supplies the fluid lubricated bearings 54 and 56 supporting the rotor shafts on the discharge side of the screw rotors 51 and 52 with the branched refrigerant. Also, anything having a throttle effect may be used for the throttle means 58 and 59 as described above.

Then, since the constitution above not only eliminates necessity of providing an oil flow passage for leading oil into the rotor room of the screw compressor 11, but also eliminates necessity of a flow passage for supplying oil as lubricant for the bearings in the screw refrigerator 7, the constitution of the overall apparatus is simplified, and the maintenance operation becomes easy.

What is claimed is:

1. A screw refrigerating apparatus comprising:

a refrigerant circulating passage, said refrigerant circulating passage including:

a screw compressor;

a rotor room within said screw compressor;

a condenser;
an expansion valve; and
an evaporator, throttle means; and a bypass flow passage branching at a part of said refrigerant circulating passage between said condenser and said expansion valve, routing through said throttle means, and communicating with said rotor room.

2. The screw refrigerating apparatus according to claim 1, wherein refrigerant circulating in said refrigerant circulating flow passage contains a quantity of lubricant as much as restraining a decrease of heat transfer efficiency due to said lubricant in said condenser and in said evaporator to a practically negligible degree.

3. The screw refrigerating apparatus according to claim 2, wherein said bypass flow passage branches from a top part of said refrigerant circulating flow passage when the specific gravity of said lubricant is lower than the specific gravity of said refrigerant, and said bypass flow passage branches from a bottom part of said refrigerant circulating flow passage when the specific gravity of said lubricant is higher than the specific gravity of said refrigerant.

4. The screw refrigerating apparatus according to claim 1, further comprising:

a discharged refrigerant temperature detector provided for detecting the refrigerant temperature between said screw compressor and said condenser, and for outputting a temperature signal indicating the detected temperature; and a variable throttle valve employed as said throttle means interposed on said bypass flow passage, wherein said variable throttle valve increases its opening as said detected temperature becomes high.

5. The screw refrigerating apparatus according to claim 1, further comprising:

a driving unit of said screw compressor, said driving unit comprising an inverter and a variable speed motor controlled by said inverter;

a temperature detector for detecting the refrigerant temperature inside said evaporator, and for outputting a temperature signal indicating the detected temperature; and a controller for receiving the temperature signal, and for outputting a control signal to said inverter to change the rotation speed of said variable speed motor so that said detected temperature is equal to a set temperature.

6. The screw refrigerating apparatus according to claim 1, further comprising:

a driving unit of said screw compressor, said driving unit comprising an inverter and a variable speed motor controlled by said inverter;

a pressure detector for detecting the refrigerant pressure between said evaporator and said screw compressor, and for outputting a pressure signal indicating the detected pressure and;

a controller for receiving the pressure signal, and for outputting a control signal to said inverter to change the rotation speed of said variable speed motor so that said detected pressure is equal to a set pressure.

7. A screw refrigerating apparatus comprising:

a refrigerant circulating passage, said refrigerant circulating passage including:
a screw compressor;
a rotor room within said screw compressor;
a condenser;
an expansion valve; and an evaporator, a fluid lubricated bearing inside said screw compressor;

first throttle means;

a bypass flow passage branching at a part of said refrigerant circulating passage between said condenser and said expansion valve, routing through said first throttle means, and communicating with said rotor room;

second throttle means; and a bearing-fluid-filling flow passage branching at a part of said refrigerant circulating passage between said condenser and said expansion valve, routing through said second throttle means, and communicating with said fluid lubricated bearing.

* * * * *